US007721941B2

(12) United States Patent
Kleiner

(10) Patent No.: US 7,721,941 B2
(45) Date of Patent: May 25, 2010

(54) PACKING CASE

(76) Inventor: Mordechai Kleiner, P.O. Box 838, Ramat-Gan (IL) 52108

( * ) Notice: Subject to any disclaimer, the term of this patent is extended or adjusted under 35 U.S.C. 154(b) by 0 days.

(21) Appl. No.: 11/767,371

(22) Filed: Jun. 22, 2007

(65) Prior Publication Data

US 2008/0067222 A1 Mar. 20, 2008

(30) Foreign Application Priority Data

Sep. 19, 2006 (ES) ..... 200602066 U

(51) Int. Cl.
*B65D 5/36* (2006.01)

(52) U.S. Cl. ..... 229/117.06; 229/117.05

(58) Field of Classification Search ..... 229/117.03, 229/117.04, 117.05, 117.06, 405
See application file for complete search history.

(56) References Cited

U.S. PATENT DOCUMENTS 284,179 A * 9/1883 Buckingham ..... 229/117.06
1,374,473 A * 4/1921 Scotcher ..... 229/117.05
2,331,493 A * 10/1943 Muhlhauser ..... 229/125.19
3,193,176 A * 7/1965 Gullickson ..... 229/117.06
3,670,948 A * 6/1972 Berg ..... 229/117.06
4,711,390 A * 12/1987 Andrews et al. ..... 229/117.06
5,062,527 A * 11/1991 Westerman ..... 229/117.06
5,294,043 A * 3/1994 Platt ..... 229/103
5,460,324 A * 10/1995 Vinther ..... 229/405
6,736,309 B1 * 5/2004 Westerman et al. .... 229/117.05
6,837,420 B2 * 1/2005 Westerman et al. .... 229/117.05

* cited by examiner

*Primary Examiner*—Gary E Elkins
(74) *Attorney, Agent, or Firm*—Steven B. Stein

(57) ABSTRACT

A packing case is provided preferably manufactured from a material on which weakening lines can be formed, such as cardboard or plastic. The packaging case includes a straight side weakening line in a center of each of two opposite folding walls of the case. The side weakening lines are vertically arranged along an entire extension of the opposite folding walls. A straight bottom weakening line is formed in a center of the bottom of the packing case, the straight bottom weakening line joining the side weakening lines together. Symmetrical sets of angled bottom weakening lines are provided, each set being arranged at each end region of the bottom of the packing case adjacent to each opposite folding wall. The weakening lines from each set are arranged parallel to one another with their vertex at the central bottom weakening line and the legs of each set ending at the base of a respective one of the opposite folding walls.

13 Claims, 5 Drawing Sheets

PACKING CASE

FIELD OF THE INVENTION

The present invention is directed to the packing field.

More precisely, the present invention relates to a packing case manufactured from a material on which weakening lines can be formed, such as cardboard, plastic, etc., the packing case comprising a rectangular bottom, walls that are orthogonal to said bottom, and weakening lines so as to allow the packing case to be folded along these weakening lines.

BACKGROUND OF THE INVENTION

The packing cases known in the state of the art are generally cases to be assembled by the user, right before they are used. The main advantage is that the unassembled case requires much less space than when assembled, which means a great saving in space at the warehouses where they are stored.

Therefore, these packing cases usually are cases which are initially shaped as a semi-rigid laminar piece, which at the moment of use is repeatedly folded until forming the case.

Generally, the known cases to be assembled require many and sometimes complicated assembly operations, which means added difficulties in the working process, causing an important loss of time.

This inconvenience has been approached by using several designs and starting blank patterns, although none of them has solved the problem of the immediate assembly of the case.

On the other hand, in the state of the art partially assembled folded cases are also known that are usually used with pallets and the same pallets, as well as wood frames, are used to make the assembly of the cases easier, as well as to provide stiffness to the same. Nevertheless, these cases do not solve the problem of a simple and fast assembly in any kind of case.

SUMMARY OF THE INVENTION

The packing case of the invention aims to solve the drawbacks set forth above concerning the assembly of cases.

The object of the invention is a packing case manufactured from a material on which weakening lines can be formed, such as cardboard, plastic, etc., the packing case comprising a rectangular bottom, walls that are orthogonal to said bottom, and weakening lines so as to allow the packing case to be folded along these weakening lines.

More precisely, the object of the invention is a packing case including:

a straight side weakening line in the center of each of two opposite folding walls of said case, said side weakening lines being vertically arranged along the entire extension of said opposite folding walls, a straight bottom weakening line in the center of said bottom, said central bottom weakening line joining said side weakening lines together, and two symmetrical sets of angled bottom weakening lines, each set being arranged at each end region of said bottom adjacent to each opposite folding wall, the weakening lines within each set being arranged parallel to one another with their vertex at said central bottom weakening line and their legs ending at the base of a respective one of said opposite folding walls.

Thus, in assembled condition, the packing case of the invention can be flattened in just one step and can also be expanded from that flattened condition in just one step, while maintaining its assembled condition, by outwardly pushing the bottom of the case and by folding said opposite folding walls inwards so as to move the other opposite walls together.

Therefore, the packing case of the invention has the advantage of being able to be kept in its assembled condition while occupying minimum space.

BRIEF DESCRIPTION OF THE DRAWINGS

Further characteristics and advantages of the invention will become apparent from the detailed description which follows, provided purely by way of non-limitative example, with reference to the accompanying drawings, in which.

DETAILED DESCRIPTION

Figure 1A:
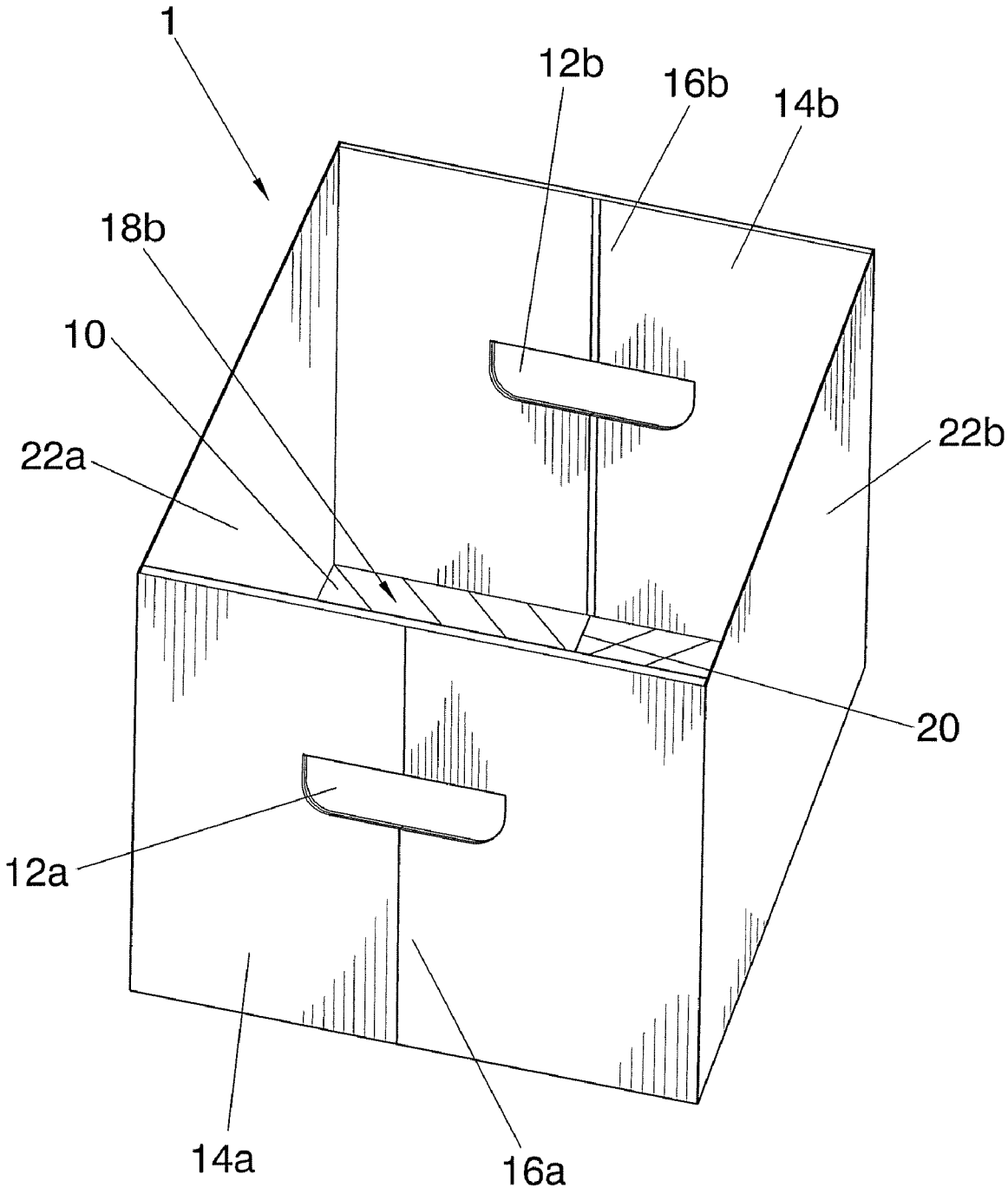
FIGS. 1A and 1B respectively show a perspective view and a top plan view of the same case, with the cover removed.
Figure 1B:
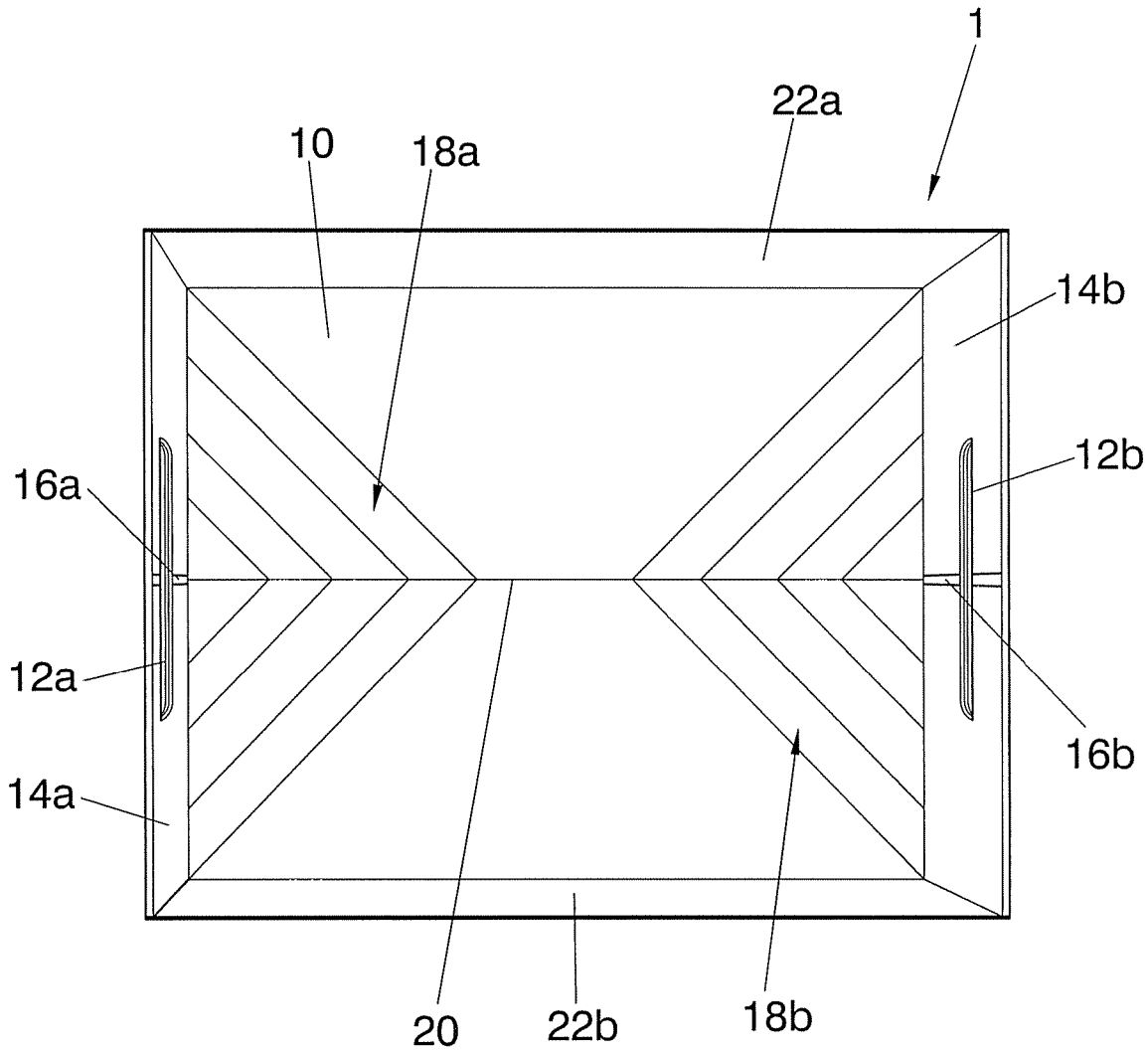

Referring to FIGS. 1A and 1B, a cardboard packing case 1 is shown in assembled condition, with a typical irregular rectangular bottom 10, which has been provided with two notches 12*a*, 12*b* serving as handles located at the upper part of respective opposite folding walls 14*a*, 14*b*.

A straight side weakening line 16*a*, 16*b* is arranged in the center of each of said opposite folding walls 14*a*, 14*h* of said case 1, said side weakening lines 16*a*, 16*b* being vertically arranged along the entire extension of said opposite folding walls 14*a*, 14*b*. Said side weakening lines 16*a*, 16*b* enable said opposite folding walls 14*a*, 14*b* to be folded inwards.

A straight bottom weakening line 20 is also arranged in the center of the bottom of the case, so as to join said side weakening lines 16*a*, 16*b* together. Said central bottom weakening line 20 enables said bottom 10 to be folded downwards.

Two symmetrical sets 18*a*, 18*b* of angled bottom weakening lines are arranged at respective end regions of said bottom 10 of the case, adjacent to each opposite folding wall 14*a*, 14*b*. The weakening lines within each set 18*a*, 18*b* are arranged parallel to one another, with their vertex at said central bottom weakening line 20 and their legs ending at the base of a respective one of said opposite folding walls 14*a*, 14*b*. The number of angled bottom weakening lines within each set, as well as the distance therebetween, will vary according to the size and material of the case. In said case 1, four angled bottom weakening lines are shown within each set 18*a*, 18*b*.

By virtue of said symmetrical sets 18*a*, 18*b* of angled bottom weakening lines, said case 1 is flattened in assembled condition by concurrently folding said opposite folding walls 14*a*, 14*b* inwards and folding said bottom 10 downwards.

Inversely, said case 1 can be expanded from that flattened condition by simply pulling the opposite walls 22*a*, 22*b* different to said opposite folding walls 14*a*, 14*b* outwards.

Figure 2:
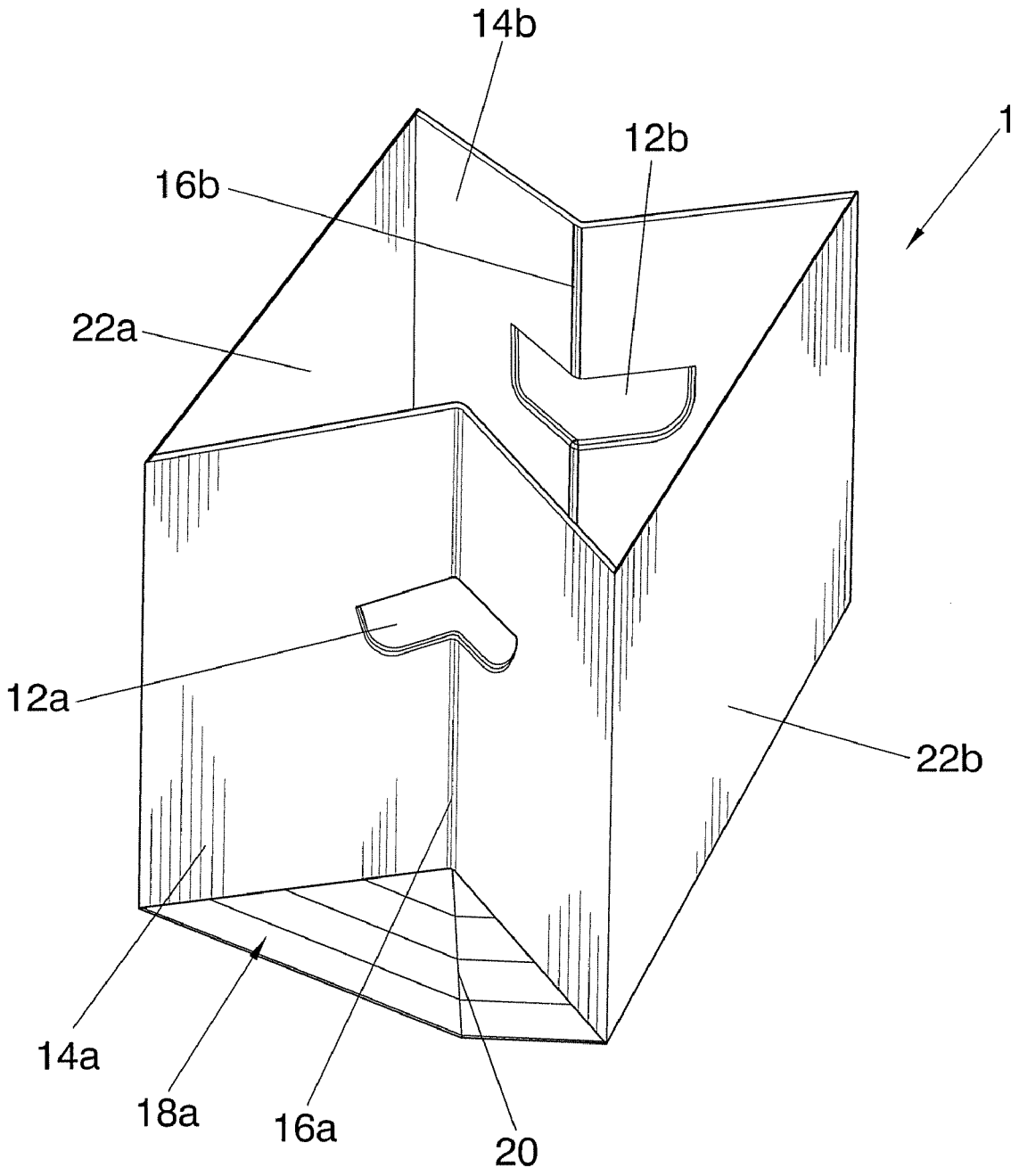
FIG. 2 shows a perspective view of the same case in a partially folded condition.
Figure 3:
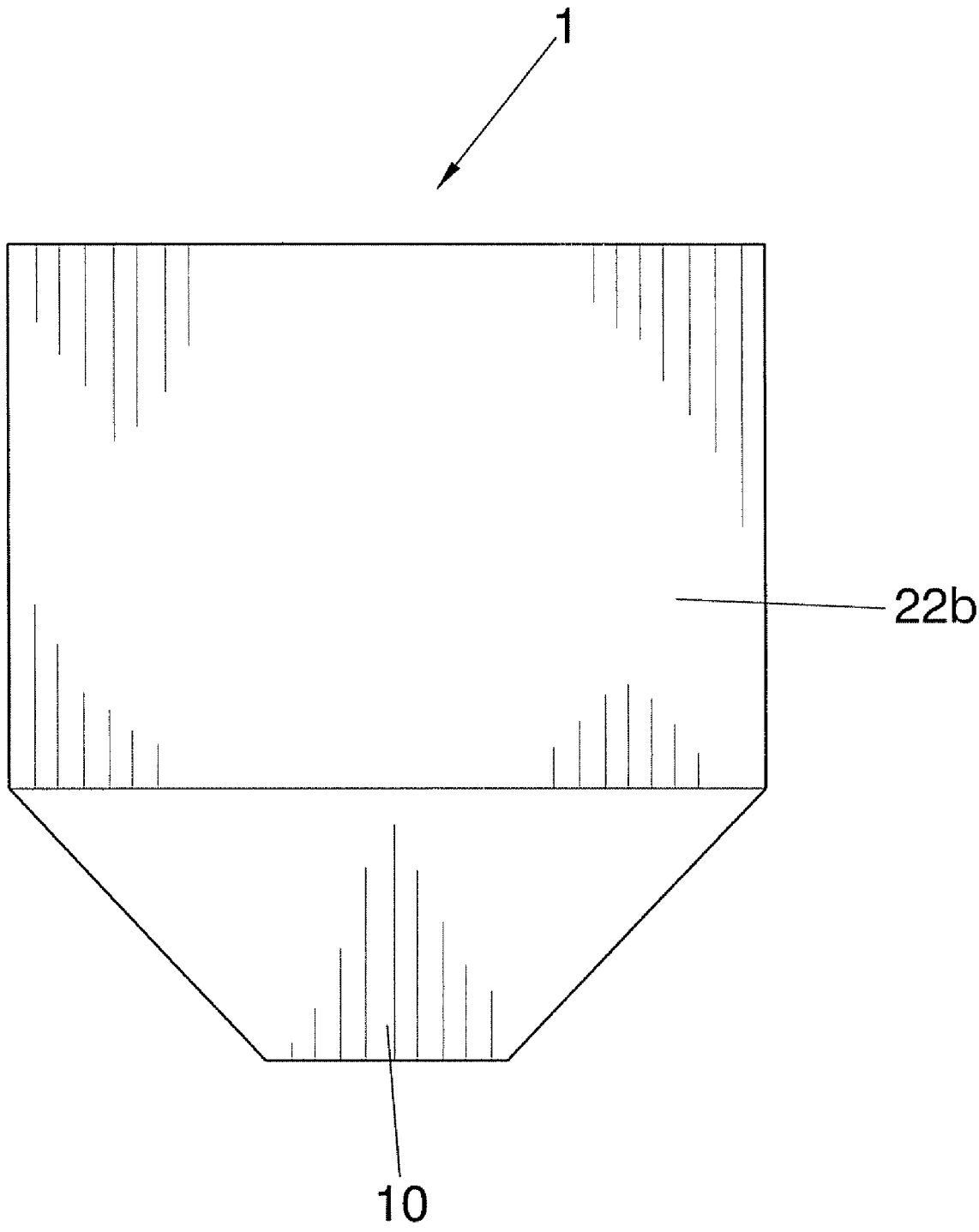
FIG. 3 shows a side view of the same case in folded condition.

Said operations may be more fully understood by referring to FIGS. 2 and 3.

In particular, FIG. 2 shows said case 1 in a partially flattened condition, with said opposite folding walls 14*a*, 14*b* partially folded outwards and said bottom 10 partially folded downwards; and FIG. 3 shows said case 1 in a flattened condition, with said bottom 10 totally folded downwards.

Figure 4:
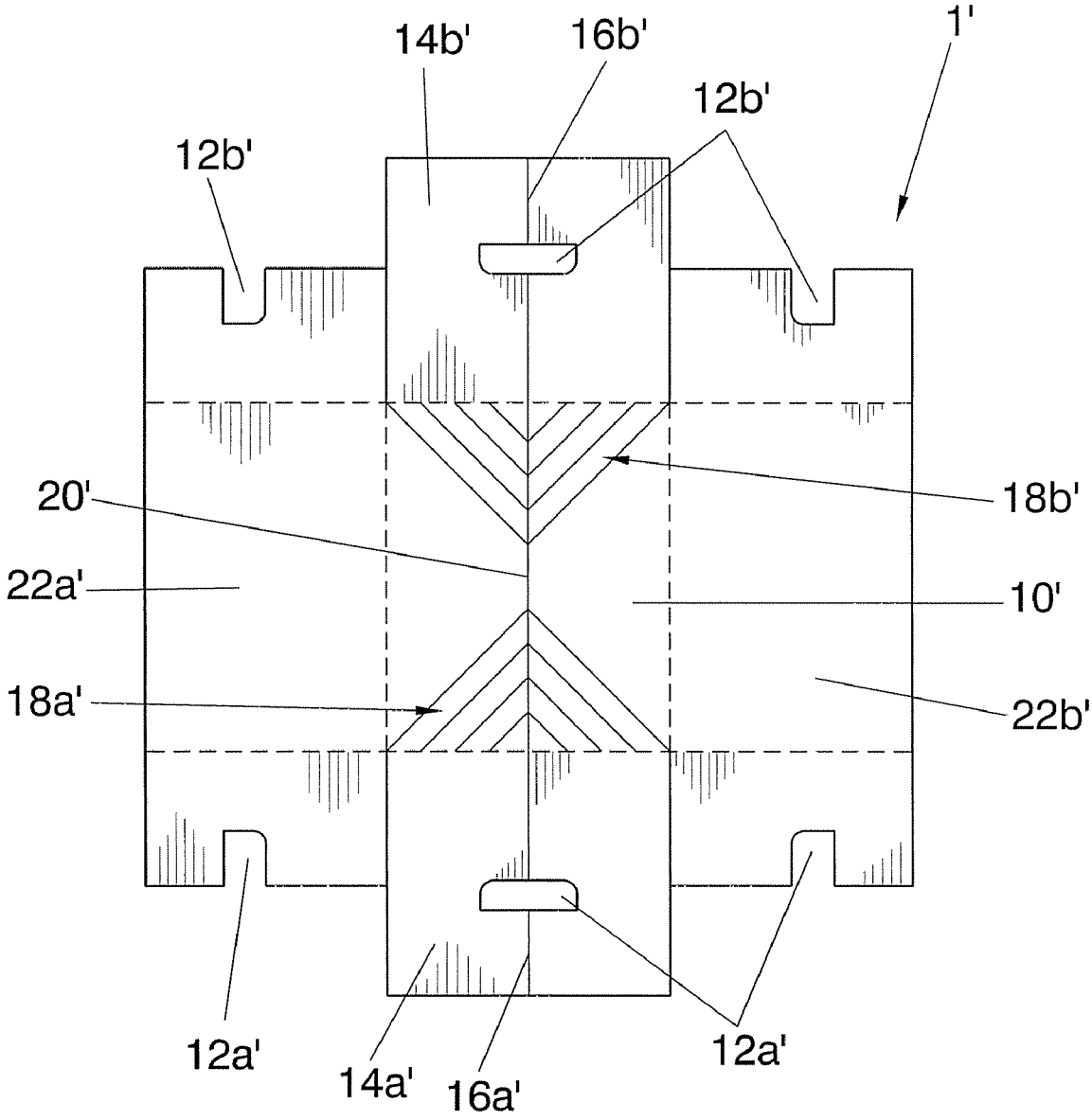
FIG. 4 shows a plan view of the starting blank of the same case, that is, the same case in unassembled condition.

FIG. 4 shows the starting blank 1' of said case 1, that is, case 1 prior to assembly, in order to further elucidate the structure of the case of the embodiment discussed above and the arrangement of the relevant features.

In FIG. 4, the same reference numerals are used to designate like features, except for a prime symbol indicating unassembled condition.

Said blank 1' thus comprises a bottom 10', opposite folding walls 14*a*', 14*b*', and opposite walls 22*a*', 22*b*'. Said bottom 10' is provided with two symmetrical sets 18*a*', 18*b*' of angled bottom weakening lines and with a central bottom weakening line 20' joining two side weakening lines 16*a*', 16*b*' together. A plurality of notches 12*a*', 12*b*' are also provided which, upon assembly, will form said notches 12*a*, 12*b* of said case 1.

Naturally, the principle of the invention remaining unchanged, embodiments and manufacturing details may vary widely from those described and illustrated purely by way of non-limitative example, without departing thereby from the scope of the invention, as defined in the appended claims.

In the discussed embodiment the bottom 10 of the case 1 is of irregular rectangular shape, but it will be understood that the bottom of the case may be of regular rectangular shape.

In the discussed embodiment the packing case 1 is made of cardboard, but it will be understood that it is possible to use other materials that are commonly used in packing techniques, such as plastic for example.

In the discussed embodiment said case 1 is to be manually assembled right before use by repeatedly folding said blank 1'. However, a factory made case, that is, a case industrially assembled into a permanent configuration and delivered to the user either in flattened or expanded condition, may be used.

Finally, in the discussed embodiment notches 12*a*, 12*b* have been provided in the opposite folding walls 14*a*, 14*b*. However, said notches 12*a*, 12*b* may be additionally or alternatively provided in the opposite walls 22*a*, 22*b* different to said opposite folding walls 14*a*, 14*b*, or they may not be provided at all.

What is claimed is:

1. A packing case manufactured from a single unfolded sheet of material on which weakening lines can be formed, comprising:

a. a rectangular bottom formed from the central area of the unfolded sheet;

b. a northern wall formed from a top area of the unfolded sheet, a southern wall formed from a bottom area of the unfolded sheet, an eastern folding wall formed from a rightward area of the unfolded sheet and a western folding wall formed from a leftward area of the unfolded sheet, i. wherein the northern wall is positioned opposite of the southern wall, and wherein the eastern folding wall is positioned opposite of the western folding wall and ii. wherein the northern wall is positioned at a right angle to the eastern folding wall and wherein each wall is positioned orthogonal to the rectangular bottom, thereby forming an inside and outside when the case is in an unfolded condition, and iii. wherein the eastern folding wall and the western folding wall each further comprise a straight side weakening line running approximately about in the center of each of the respective folding walls, each side weakening line arranged vertically from each folding wall top to each folding wall bottom, where the folding wall joins the bottom, each side weakening line facilitating the inward folding of each of the folding walls into the inside of the packing case, and iv. wherein the eastern folding wall further comprises an eastern outer handle aperture; and v. wherein the western folding wall further comprises a western outer handle aperture; and vi. wherein the bottom further comprises a straight central bottom weakening line positioned approximately about in the center of the bottom, the central bottom weakening line running horizontally from the eastern folding wall bottom to the western folding wall bottom, thereby joining the eastern folding wall side weakening line and the western folding wall side weakening line, the central bottom weakening line facilitating the outward folding of the bottom away from the inside of the packing case, and vii. wherein the bottom further comprises two symmetrical sets of angular bottom weakening lines, each set being a plurality of parallel angular bottom weakening lines arranged wherein at least one southeastern angular weakening line of said plurality of parallel angular bottom weakening lines is arranged diagonally from the juncture of the eastern folding wall, the southern wall and the bottom to the central bottom weakening line at a position on the central bottom weakening line between the eastern folding wall and the center of the bottom, and wherein at least one southwestern angular weakening line of said plurality of parallel angular bottom weakening lines is arranged diagonally from the juncture of the western folding wall, the southern wall and the bottom to the central bottom weakening line at a position on the central bottom weakening line between the western folding wall and the center of the bottom, and wherein at least one northeastern angular weakening line of said plurality of parallel angular bottom weakening lines is arranged diagonally from the juncture of the eastern folding wall, the northern wall and the bottom to a central bottom weakening line at a position on the central bottom weakening line between the eastern folding wall and the center of the bottom, and wherein at least one northwestern angular weakening line of said plurality of parallel angular bottom weakening lines is arranged diagonally from the juncture of the western folding wall, the northern wall and the bottom to the central bottom weakening line at a position on the central bottom weakening line between the western folding wall and the center of the bottom, wherein the angular bottom weakening lines are capable of facilitating the outward folding of the bottom away from the inside of the packing case;

c. a northwestern notched inner panel formed from the top left area of the unfolded sheet, a southwestern notched inner panel formed from the bottom left area of the unfolded sheet, a northeastern notched inner panel formed from the top right area of the unfolded sheet, and a southeastern notched inner panel formed from the bottom right area of the unfolded sheet, i. wherein the northwestern notched inner panel is positioned opposite of the northeastern notched inner panel, and wherein the southwestern notched inner panel is position opposite of the southeastern notched inner panel and ii. wherein the northwestern notched inner panel and the southwestern notched inner panel are adjacent to one another and together form a western inner handle aperture in the folded position, and iii. wherein the northeastern notched inner panel and the southeastern notched inner panel are adjacent to one another and together form a eastern inner handle aperture in the folded position, and iv. wherein the western inner handle aperture is approximately aligned with the western outer handle aperture; and v. wherein the eastern inner handle aperture is approximately aligned with the eastern outer handle aperture.

2. The packing case according to claim 1, wherein said bottom has an irregular rectangular shape.

3. The packing case according to claim 1, wherein said bottom has a regular rectangular shape.

4. The packing case according to claim 1, wherein each set of angular bottom weakening lines has four angular bottom weakening lines.

5. The packing case according to claim 1, wherein the case is made of cardboard.

6. The packing case according to claim 1, wherein the case is made of plastic.

7. The packing case according to claim 1, wherein the case is manually assembled.

8. The packing case according to claim 1, wherein the case is factory assembled.

9. The packing case according to claim 1, which is flattened by concurrently folding said opposite folding walls inwards and folding said bottom downwards, and then optionally expanded by pulling the opposite walls different to said opposite folding walls outwards.

10. The case according to claim 1, wherein the case is in the shape of a hexagon when the case is folded by outwardly folding the bottom along the angular bottom weakening lines and inwardly folding the eastern folding wall and the western folding wall along the side weakening lines.

11. The case according to claim 1 further comprising handles integral with the eastern folding wall and the western folding wall.

12. The case according to claim 1 further comprising a removable top lid.

13. The case according to claim 1, wherein the case is comprised of a single sheet of material.

* * * * *